US005890925A

United States Patent [19]

Bernardini

[11] Patent Number: 5,890,925

[45] Date of Patent: Apr. 6, 1999

[54] ELECTRICAL CONNECTOR WITH SCREW-ON OR TWIST-ON ELECTRICAL CONTACTS

[75] Inventor: Allen J. Bernardini, Southbury, Conn.

[73] Assignee: Litton Systems, Inc., Watertown, Conn.

[21] Appl. No.: 782,057

[22] Filed: Jan. 13, 1997

[51] Int. Cl.[6] ..... H01R 4/26; H01R 11/20

[52] U.S. Cl. ..... 439/433

[58] Field of Search ..... 439/891, 415, 439/879, 877, 878, 433

[56] References Cited

U.S. PATENT DOCUMENTS

| | | | |
|---|---|---|---|
| 2,434,475 | 1/1948 | Sullivan | 439/764 |
| 3,059,216 | 10/1962 | Cunningham | 439/745 |
| 3,210,720 | 10/1965 | Harris | 439/891 |
| 4,170,393 | 10/1979 | Mocek et al. | 439/891 |
| 5,083,935 | 1/1992 | Herman | 439/433 |
| 5,399,110 | 3/1995 | Morello et al. | 439/891 |

*Primary Examiner*—Neil Abrams
*Assistant Examiner*—Eugene G. Byrd
*Attorney, Agent, or Firm*—Michael H. Wallach

[57] ABSTRACT

The present invention relates in general to electrical wire connectors and more specifically to multi-pin screw-on or twist-on electrical contacts. An electrical set of male and female contacts is provided which can each connect one or more wires without tools. The contacts of the present invention can be installed into their respective plug and receptacle housing bodies for the purpose of creating an electrical connector which can be mated and unmated many times to hook up or remove from service any electrical device or circuit.

13 Claims, 2 Drawing Sheets

ELECTRICAL CONNECTOR WITH SCREW-ON OR TWIST-ON ELECTRICAL CONTACTS

FIELD OF THE INVENTION

The present invention relates in general to electrical wire connectors and more specifically to screw-on or twist-on electrical contacts for use in an electrical connector which can be mated and unmated multiple times without the use of a specialized tool.

BACKGROUND TO THE INVENTION

Methods for attaching single or multiple wires to the rear end of a pin or socket contact which can be installed in an electrical connector are well known in the art. Most of these methods require some kind of tool to accomplish the termination. Examples of existing methods to connect wires to the contact include soldering, crimping, wire wrapping, insulation displacement and compression of the wires between a screw or an anvil and terminal base.

U.S. Pat. No. 257,865 (Hamilton) discloses an electrical connection formed at the distal end of a wire bundle by means of a male, threaded screw having a securing external sleeve. This patent is of interest as it describes an electrical cable with integral male jack. U.S. Pat. No. 1,175,343 (Conrad) teaches the use of a set of resilient arms which can be used as retainers to fix a connector in its socket.

U.S. Pat. No. 3,156,762 (Matthysse) is of interest as it teaches the use of an internally threaded conductive member within an insulative outer layer.

U.S. Pat. No. 5,083,935 (Herman) is of interest as it illustrates the use of a male connector in mating to a second female section.

There exists, in the electrical field, devices known as "wire twist-ons" which allow the user to join two or more wires together for the purpose of wiring lights and switches or making splices. While these connectors do not require elaborate tools to terminate the wires on the connector, the nature of the connector itself does not allow wires to be connected or disconnected with power applied because such connectors expose bare, possibly live wires, when removed.

There is a need in the commercial arts for a multi-pin connector system which is capable of terminating single or multiple wires into detachable electrical contacts without tools. This is especially important in applications involving only small quantities of connectors, such as for personal use. It is also useful in applications where the user does not have the necessary tools to terminate the wires in the contact. There is also a need in the commercial arts for a multi-pin wire connector product which allows the electrical contacts to be connected and disconnected with power applied so that electrical devices can easily and safely be added or removed multiple times from the electrical circuit. There is also a need in the commercial arts for a multi-pin electrical connector which can be repaired to replace damaged contacts or whose configuration can be altered in the field to add or remove electrical connections.

SUMMARY OF THE INVENTION

According to the present invention, an electrical set of male and female contacts is provided which can each connect multiple wires without requiring special tools. The contacts of the present invention can be installed into their respective plug and receptacle housing bodies for the purpose of creating an electrical connector which can be mated and unmated many times to hook up or remove from service any electrical device or circuit. The housing bodies can hold one or more pins or contacts, and the contacts can be added or removed from the connector body to replace damaged contacts or to increase or decrease the number of contacts in the body. The electrical contacts of the present invention have a small diameter wire bucket with a tapered tapped internal thread into which a stripped wire can be manually threaded. The tapered tapped sharp threads cut into the wire surfaces, so as to displace oxides while creating an excellent, gas-tight electrical and mechanical connection. In one aspect of the present invention, the threads of the contacts are sharp enough to cut through insulation so that no stripping of insulation is required. The contact can then be releasably inserted into the desired contact hole in the insulated housing body. The rear cable or wire bundle can then be optionally secured by manually screwing down a mechanical clamping device on the rear of the connector housing body. The present invention is particularly useful in applications involving only a small quantity of connectors, such as for personal use. In addition, the present invention is also useful where the user does not have the necessary tools to terminate the wires to new contacts in the connector. For many applications, such as theatrical lighting, event staging or industrial situations where circumstances might require additional wiring to be installed between electrical connectors, it is preferable to be able to modify or repair the connectors in the field to add additional wires and corresponding pins rather than having to do a full scale replacement of existing connectors. The present invention would allow additional contacts to be added to an existing connector without a re-wiring or replacement of the entire connector set.

Therefore, one aspect of the invention provides for a set of male and female electrical wire connectors comprising a male section and female section, the male section and the female section each having a male and female termination means respectively for termination of one or more wires without tools, and the female section configured to releasably receive the male section so that electrical current may be conducted therethrough.

Another aspect of the invention provides for a set of multi-pin male and female electrical wire connectors comprising a male section and female section, the male section and the female section each having a plurality of male and female termination means respectively for termination of one or more wires without tools, and the female section configured to releasably receive the male section so that electrical current may be conducted therethrough.

BRIEF DESCRIPTION OF THE DRAWINGS

A detailed description of the preferred embodiment is provided herein below with reference to the following drawings.

DETAILED DESCRIPTION OF THE PREFERRED EMBODIMENT

Figure 1:
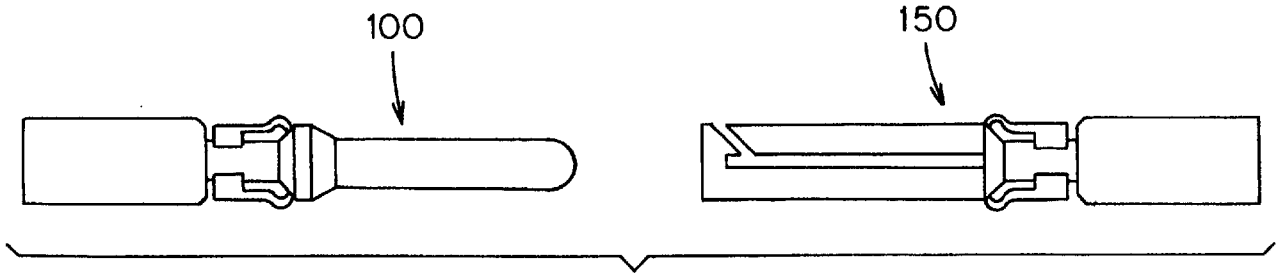
FIG. 1 is a perspective view of the set of electrical contacts of the present invention.
Figure 2:
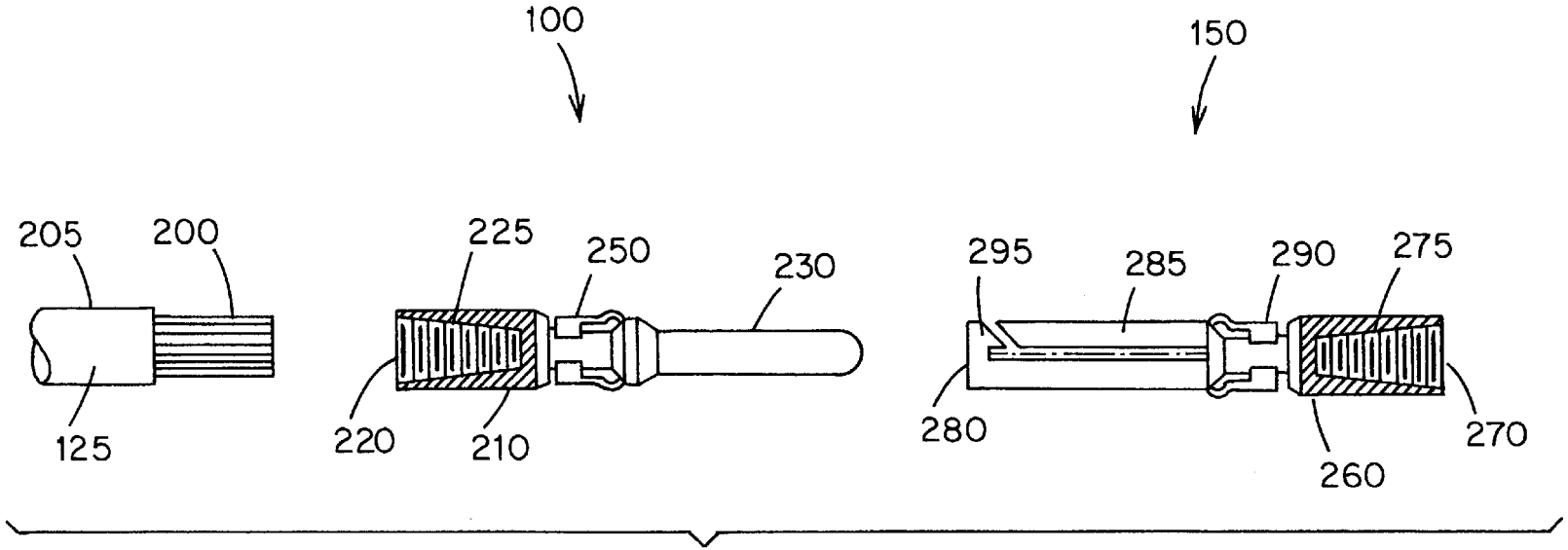
FIG. 2 is a cross-sectional view of the set of contacts of the present invention.

Turning to FIG. 1, the contacts of the present invention are shown in accordance with the preferred embodiment, comprising male portion 100 and female portion 150. In FIG. 2, the male portion 100 and female portion 150 of FIG. 1 are shown in greater detail. Male portion 100 is comprised of male wiring socket 210, male retention clip 250 and male contact 230. Disposed in male wiring socket 210 is male contact wire bucket 220 which is formed to receive one or more of conductor portions 200 of wire 125. Conductor portions 200 may be stranded or solid. Male contact wire bucket 220 contains threads 225 which have been tapped into the bucket 220 using standard machining methods. The threads 225 are sharp, preferably tapered and designed to cut into the wire surfaces so as to displace oxides and create an excellent, gas-tight electrical and physical connection.

In order to connect wire 125 to male wiring socket 210, the wire 125 is stripped of wire insulation 205 to expose conductor portion 200, using well known techniques. The male contact can then be screwed or twisted on to conductor portion 200 of the wire. The sharp threads 225 cut into the wire surfaces, compressing the conductor portion 200 and form the electrical connection to the contact. In an alternate embodiment (not shown), the threads 225 are produced with very sharp crests such that the threads 225 are capable of cutting through insulation 205 to make contact with the conductor portion 200. In multi-wire applications, the conductor portion 200 of multiple wires 125 may be inserted and screwed into male contact bucket 220 to complete a multi-wire connection. The threaded aspect of male contact bucket 220 allows the conductor portion 2.00 of one or more wires 125 to be added or removed from the connector as changed or repairs are required, without the necessity of tools. Male contact 230 and male wiring socket 210 are composed of a suitable electrically conductive material, preferably a copper alloy with a protective plating, but alternatively copper or brass. The connection can be performed without tools. Female portion 150 is comprised of female wiring socket 260, female coupler 285 and female retention clip 290. Female receptacle 280 is disposed within female coupler 285. Female wiring socket 260 and female coupler 285 are composed of a suitable conductive material, preferably a copper alloy and a protective plating. Female wiring socket 260 is disposed with female contact wire bucket 270 which has been tapped with sharp threads 275, preferably tapered, structured in a similar manner and of similar composition as the male wiring socket 210. Also, wire 175 may contain a conductor portion which is stranded or solid (not shown), similar to wire 125. One or more of wires 175 are attached to female portion 150 in a similar manner as described above with reference to male portion 100 and wire 125.

The connection of male portion 100 to female portion 150, for completion of the electrical circuit, is provided by inserting male contact 230 into female receptacle 280.

Figure 3:
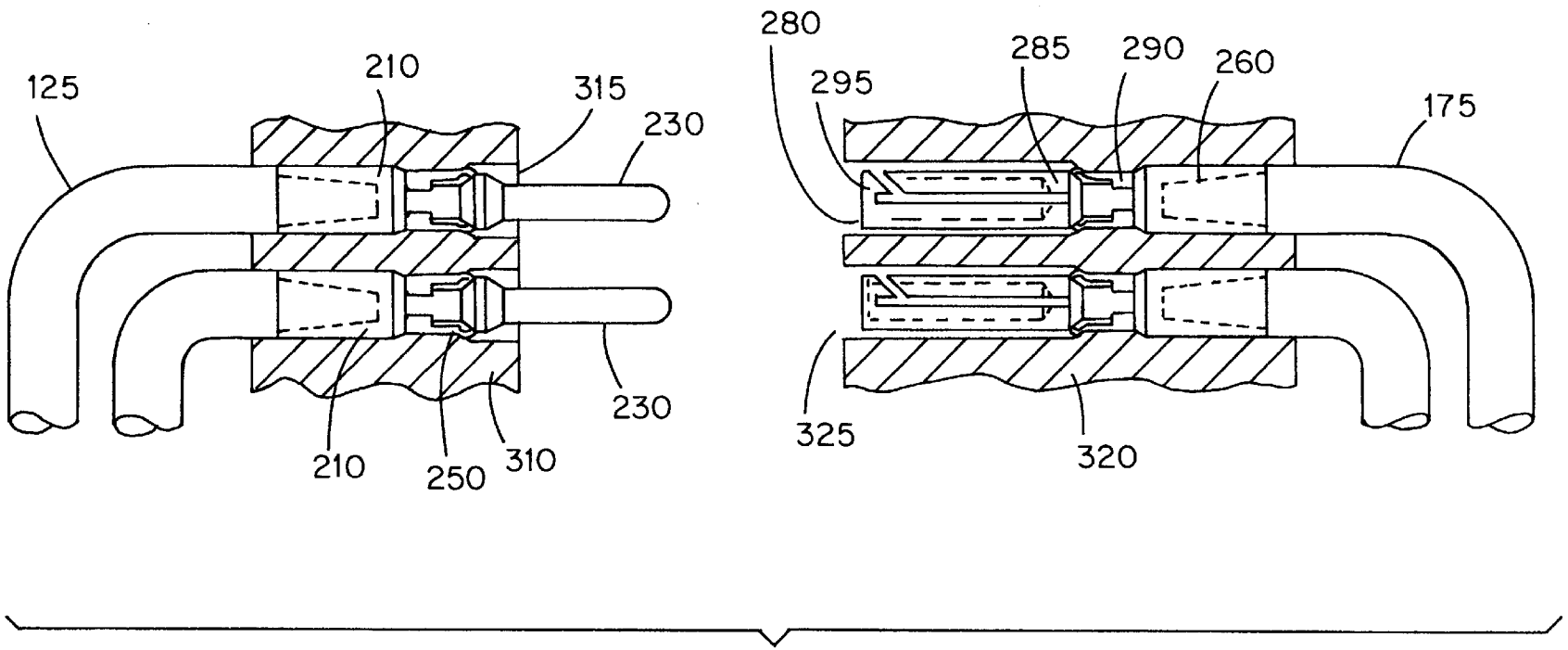
FIG. 3 is a cross-sectional view of the set of contacts inside the respective male and female connectors bodies in a multi-pin configuration.

Turning to FIG. 3, a two pin configuration is shown. Two male portions 100 and two female portions 150 are shown inserted in male connector body 310 and female connector body 320 respectively. Male portion 100 is held inside male connector body 310 by male retention clip 250. Male retention clip 250 and female retention clip 290 are each composed of a flexible material, preferably metal or plastic, which exhibits a resistance force when bent. When male portion 100 is inserted in male connector body 310, it passes through hollow channel 315. Hollow channel 315 narrows so that male retention clip 250 exhibits force against the wall of hollow channel 315, thereby fixing male portion 100 within male connector body 310. Male portion 100 may optionally be removed from male connector body 310 to repair or replace a damaged connector, or to affix additional wires into either the male portion 100 or the female portion 150 of the connector. Similarly, female portion 150 is lodged within female connector body 320 by inserting female portion 150 through hollow channel 325 so that female retention clip 290 exhibits a force fixing female portion 150 within female connector body 320. Both male and female connector bodies 310 and 320 are composed of a suitable insulating material such as plastic. In an alternate embodiment, (not shown) male connector body 310 and female connector body 320 may be moulded or constructed and disposed with three or more hollow channels each so that a multiple number of male contacts 230 and female receptacles 280 can be connected within the same electrical connector. The electrical connection is made by inserting male contact 230 of male portion 100 into female receptacle 280 of female connector body 320. In the example shown in FIG. 3, male contact 230 is held in place by spring member 295 of female coupler 285, but other retention means, such as friction fit may be used. It is also possible (not shown) to use a threaded clamp to mechanically hold the male and female portions of the connector together by methods well known in the art. Thus, multiple or single wires can be inserted in connectors without tools being required which allow the connection to be mated and unmated while the connection is live.

Alternative embodiments of the invention are possible without departing from the sphere and scope as set forth in the claims appended hereto.

I claim:

1. A set of male and female electrical wire connectors, comprising:

a male assembly and a female assembly;

said male assembly including a male contact and a wiring socket having a tapped tapered wire bucket having sharp threads for releasably receiving and retaining at least one wire;

said female assembly including a female contact and a wiring socket having a tapped tapered wire bucket having sharp threads for releasably receiving and retaining at least one wire; and said female contact configured to releasably receive said male contact so that electrical current may be conducted therethrough;

whereby said male and female assemblies can be repaired in the field without tools.

2. The set of male and female electrical wire connectors of claim 1, wherein said male assembly further comprises a retention clip joining said male contact and said wiring socket and a male insulating body having a throughbore; and said female assembly further comprises a retention clip joining said female contact and said wiring socket a female insulating body having a throughbore.

3. The set of male and female electrical wire connectors of claim 2, wherein said retention clip of said male assembly extends radially outwardly beyond said male contact and said wiring socket and said retention clip of said female assembly extends radially outwardly beyond said female contact and said wiring socket, said retention clips being formed of a flexible material.

4. The set of male and female electrical wire connectors of claim 3, wherein said retention clip of said male assembly is of a larger diameter than said throughbore of said male insulating body such that said retention clip exerts a force against said throughbore and said male assembly is held in said male insulating body and said male contact protrudes beyond one end of said male insulating body; and said retention clip of said female assembly is of a larger diameter than said throughbore of said female insulating body such that said retention clip exerts a force against said throughbore and said female assembly is held in place in said female insulating body.

5. A set of multi-pin male and female electrical wire connectors comprising:

a male insulating body and a female insulating body, said male insulating body and said female insulating body each including a plurality of throughbores;

a plurality of male assemblies and a plurality of female assemblies each positioned in a corresponding throughbore, each of said male assemblies including a male contact, a wiring socket and a retention clip, said retention clip joining said male contact and said wiring socket;

each of said female assemblies including a female contact, a wiring socket and a retention clip, said retention clip joining said female contact and said wiring socket;

each of said female assemblies configured to releasably receive a corresponding said male assembly so that electrical current may be conducted therethrough.

6. The set of multi-pin male and female electrical wire connectors of claim 5, wherein said retention clip of said male assembly extends radially outwardly beyond said male contact and said wiring socket and said retention clip of said female assembly extends radially outwardly beyond said female contact and said wiring socket, said retention clips being formed of a flexible material.

7. The set of multi-pin male and female electrical wire connectors of claim 6, wherein said retention clip of said male assembly is a larder diameter than said throuqhbore of said male insulating body such that said retention clip exerts a force against said throughbore and said male assembly is held in said male insulating body and said male contact protrudes beyond one end of said male insulating body; and said retention clip of said female assembly is of a larder diameter than said throughbore of said female insulating body such that said retention clip exerts a force against said throughbore and said female assembly is held in place in said female insulating body.

8. The set of male and female electrical wire connectors of claim 5, wherein said wiring socket of said male connector includes a tapped tapered wire bucket having sharp threads for releasably receiving and retaining at lest one wire and wherein said wiring socket of said female connector includes a tapered wire bucket having sharp threads for releasably receiving and retaining at least one wire.

9. A set of male and female electrical wire connectors, comprising:

a male assembly and a female assembly;

said male assembly including a male contact, a wiring socket and a retention clip, said retention clip joining said male contact and said wiring socket;

said female assembly including a female contact and a wiring socket and a retention clip, said retention clip joining said female contact and said wiring socket; and said female contact configured to releasably receive said male contact so that electrical current may be conducted therethrough.

10. The set of male and female electrical wire connectors of claim 9, wherein said wiring socket of said male connector includes a tapped tapered wire bucket having sharp threads for releasably receiving and retaining at lest one wire and wherein said wiring socket of said female connector includes a tapered wire bucket having sharp threads for releasably receiving and retaining at least one wire.

11. The set of male and female electrical wire connectors of claim 9, wherein said male assembly further comprises a male insulating body having a throughbore; and said female assembly further comprises a female insulating body having a throughbore.

12. The set of male and female electrical wire connectors of claim 11, wherein said retention clip of said male assembly extends radially outwardly beyond said male contact and said wiring socket and said retention clip of said female assembly extends radially outwardly beyond said female contact and said wiring socket, said retention clips being formed of a flexible material.

13. The set of male and female electrical wire connectors of claim 12, wherein said retention clip of said male assembly is of a larger diameter than said throughbore of said male insulating body such that said retention clip exerts a force against said throughbore and said male assembly is held in said male insulating body and said male contact protrudes beyond one end of said male insulating body; and said retention clip of said female assembly is of a larger diameter than said throughbore of said female insulating body such that said retention clip exerts a force against said throughbore and said female assembly is held in place in said female insulating body.

* * * * *